US009016296B1

(12) United States Patent
Ma

(10) Patent No.: US 9,016,296 B1
(45) Date of Patent: Apr. 28, 2015

(54) UMBRELLA STRUCTURE

(71) Applicant: Joen-Shen Ma, Taipei (TW)

(72) Inventor: Joen-Shen Ma, Taipei (TW)

( * ) Notice: Subject to any disclaimer, the term of this patent is extended or adjusted under 35 U.S.C. 154(b) by 0 days.

(21) Appl. No.: 14/288,561

(22) Filed: May 28, 2014

(51) Int. Cl.
*A45B 25/02* (2006.01)
*A45B 25/00* (2006.01)

(52) U.S. Cl.
CPC ..... *A45B 25/00* (2013.01)

(58) Field of Classification Search
CPC ... A45B 25/02; A45B 25/22; A45B 2019/001
USPC ..... 135/27, 29, 31–32
See application file for complete search history.

(56) References Cited

U.S. PATENT DOCUMENTS

| | | | | | |
|---|---|---|---|---|---|
| 974,643 | A * | 11/1910 | Carlson | 135/25.32 |
| 1,104,598 | A * | 7/1914 | Wyskosky | 135/23 |
| 1,167,431 | A * | 1/1916 | Raabe | 135/27 |
| 2,616,439 | A * | 11/1952 | Thompson | 135/25.31 |
| 4,030,515 | A * | 6/1977 | Weber | 135/25.3 |
| 6,006,770 | A * | 12/1999 | Lin et al. | 135/33.7 |
| 6,397,866 | B1 * | 6/2002 | You | 135/23 |
| 2003/0079765 | A1 * | 5/2003 | Lin et al. | 135/16 |
| 2003/0159725 | A1 * | 8/2003 | Chou et al. | 135/29 |
| 2005/0103369 | A1 * | 5/2005 | Lin et al. | 135/25.3 |
| 2007/0034242 | A1 * | 2/2007 | Chuang | 135/30 |

* cited by examiner

*Primary Examiner* — Winnie Yip
(74) *Attorney, Agent, or Firm* — Rosenberg, Klein & Lee

(57) ABSTRACT

An umbrella structure includes a shaft, a top notch fixed at the top end of the shaft, a runner mounted around and slidable along the shaft, plural ribs, plural stretchers, a canopy, and plural torsion springs. Each rib has an upper end pivotally connected to the top notch. Each stretcher has an upper end pivotally connected to an intermediate portion of one of the ribs and a lower end pivotally connected to the runner. The canopy can be opened or closed by sliding the runner upward or downward along the shaft. One torsion spring is provided where each rib is pivotally connected to the corresponding stretcher. When the runner is slid downward to close the canopy, each torsion spring is compressed and stores energy. When the runner is slid upward to open the canopy, each torsion spring releases the stored energy to reduce the effort required for opening the canopy.

2 Claims, 4 Drawing Sheets

UMBRELLA STRUCTURE

BACKGROUND OF THE INVENTION

1. Technical Field

The present invention relates to an umbrella structure. More particularly, the present invention relates to an improved umbrella structure in which a torsion spring is provided where each rib is pivotally connected to the corresponding stretcher, and in which each torsion spring can provide an elastic restoring force for opening the canopy, thereby allowing the umbrella structure to be opened with more ease and less effort.

2. Description of Related Art

Umbrellas and parasols (hereinafter collectively referred to as umbrellas) are available in a great variety, including portable compact umbrellas, large beach umbrellas, and garden umbrellas, to name only a few. While umbrellas differ in size and configuration, their functions are more or less the same, i.e., to protect against rain and/or sunlight.

In terms of manufacture, different types of umbrellas are often equipped with different parts or devices to facilitate opening. For instance, a large beach umbrella or garden umbrella is typically provided with a pulling cord and a rotating handle so that the runner can be pulled via the rotating handle and the puling cord to open the umbrella. Some portable, automatic compact umbrellas have a spring and related parts installed in their shafts and are opened by means of the elastic restoring force of the spring, which drive the runner to slide.

However, the shaft of such a conventional automatic umbrella tends to be relatively thick and heavy due to the spring and the related parts installed therein. The plurality of parts also contribute to structural complexity and consequently higher risks of function failure.

BRIEF SUMMARY OF THE INVENTION

It is an objective of the present invention to provide an improved umbrella structure which can overcome the foregoing drawbacks of the conventional umbrellas, namely having a large number of complicated parts and being both bulky and heavy.

The most obvious feature of the present invention is this: springs in the simplest of forms are used to provide the force required for opening the canopy of an umbrella. The improved umbrella structure of the present invention is intended to feature compactness, lightweight, ease of opening, and an effort-saving effect.

To achieve the above and other objectives, the following technical solutions are adopted in the present invention.

The improved umbrella structure of the present invention includes a shaft, a top notch, a runner, a plurality of ribs, a plurality of stretchers, a canopy, and a plurality of torsion springs.

The top notch is fixed at the top end of the shaft.

The runner is mounted around the shaft and can slide upward and downward along the shaft.

Each of the ribs has an upper end pivotally connected to the top notch. Each of the stretchers has an upper end pivotally connected to an intermediate portion of one of the ribs and has a lower end pivotally connected to the runner. The canopy can be opened or closed by sliding the runner upward or downward along the shaft.

Each of the torsion springs is provided where one of the ribs is pivotally connected to the corresponding one of the stretchers. When the runner is slid downward to close the canopy, each torsion spring is compressed and stores energy therein.

Conversely, when the runner is slid upward to open the canopy, each torsion spring releases the energy stored therein and thereby drives the corresponding rib to open the canopy. As such, the umbrella structure of the present invention can be opened with less effort than required by its prior art counterparts.

The improved umbrella structure of the present invention not only is lighter but also incurs lower production costs than the conventional automatic umbrellas because the torsion springs used in the present invention are small and lightweight and are each installed where one of the ribs is pivotally connected to the corresponding stretcher, eliminating the need to equip the shaft with complicated internal parts. The intended objective of the present invention is thus achieved.

The structure of the present invention is simple and applicable to large beach umbrellas and garden umbrellas as well as compact umbrellas. In either case, the torsion springs will assist the corresponding ribs in opening the canopy, making it easier to open the umbrella structure.

BRIEF DESCRIPTION OF THE SEVERAL VIEWS OF THE DRAWINGS

The components and structures of some illustrative embodiments of the present invention will be detailed hereinafter with reference to the accompanying drawings, in which.

DETAILED DESCRIPTION OF THE INVENTION

Figure 1:
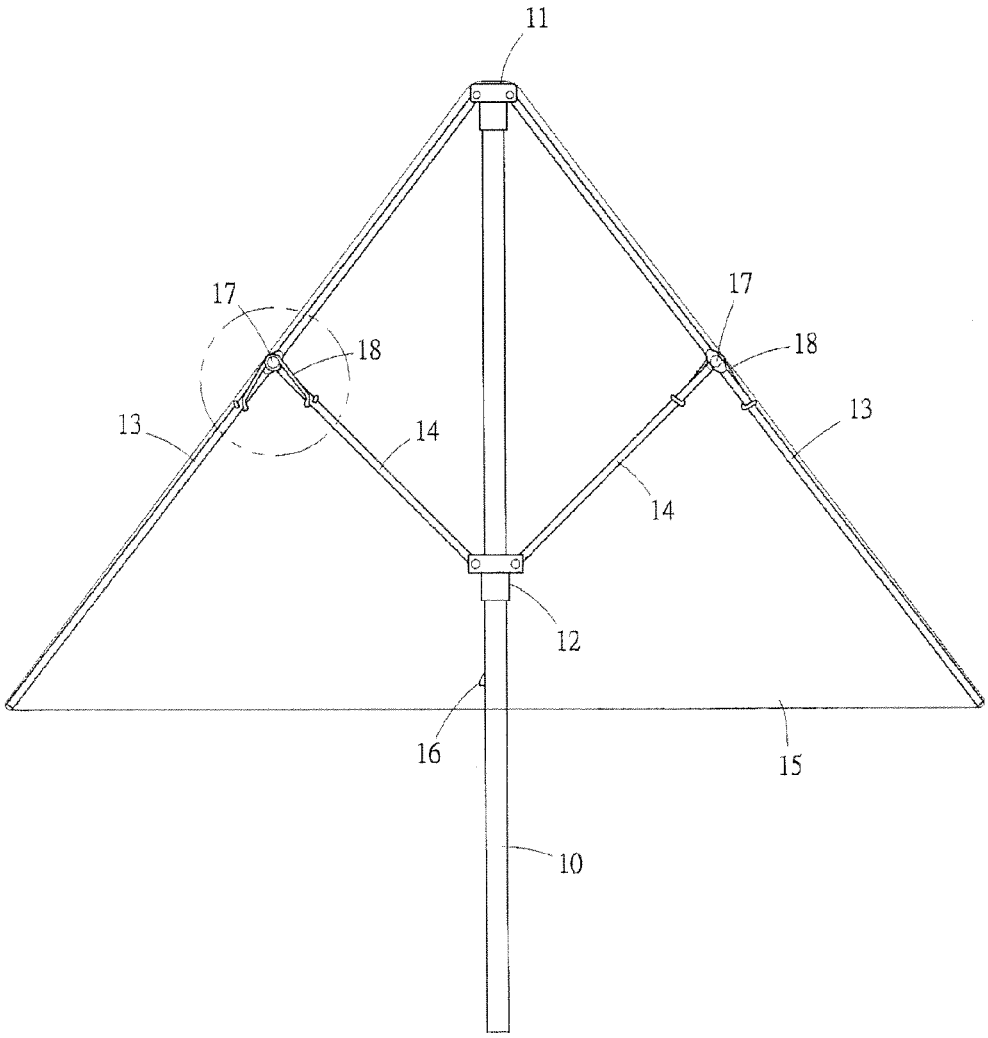
FIG. 1 is a schematic drawing of an improved umbrella structure of the present invention.

FIG. 1 schematically shows an improved umbrella structure of the present invention.

Figure 2:
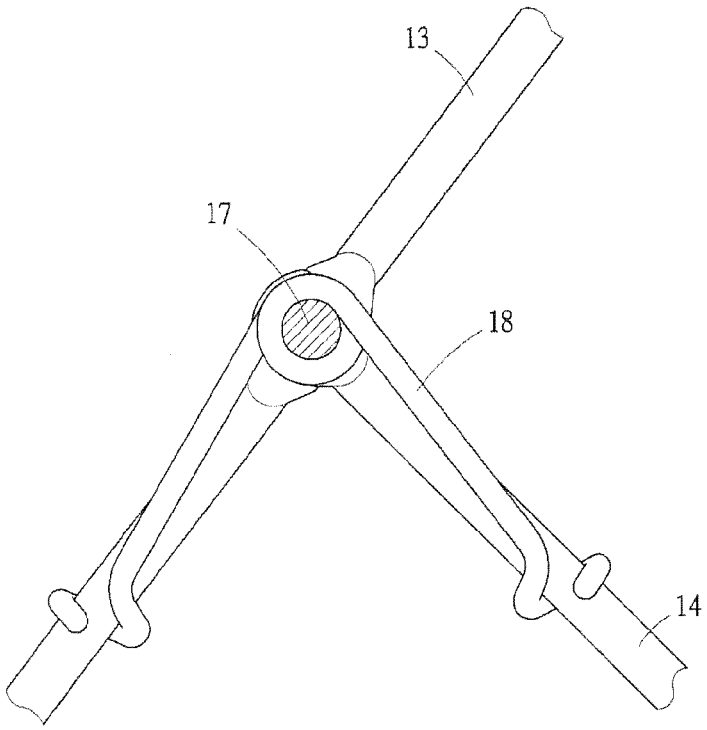
FIG. 2 is an enlarged view of the portion where one of the ribs and the corresponding stretcher in FIG. 1 are pivotally connected.

FIG. 2 is an enlarged view of the portion where one of the ribs 13 and the corresponding stretcher 14 in FIG. 1 are pivotally connected.

As shown in FIG. 1 and FIG. 2, the improved umbrella structure of the present invention includes a shaft 10, atop notch 11, a runner 12, a plurality of ribs 13, a plurality of stretchers 14, a canopy 15, and a plurality of torsion springs 18.

The shaft 10 is provided with an elastic protruding catch 16 for fixing the runner 12 in position on the shaft 10.

The top notch 11 is fixed at the top end of the shaft 10.

The runner 12 is mounted around the shaft 10 and can slide upward and downward along the shaft 10.

Each rib 13 has an upper end pivotally connected to the top notch 11.

Each stretcher 14 has an upper end pivotally connected to an intermediate portion of one of the ribs 13 by a pivot pin 17. The lower end of each stretcher 14 is pivotally connected to the runner 12.

The canopy 15 covers and is connected to each rib 13.

Each torsion spring 18 is mounted around one pivot pin 17, by which one of the ribs 13 is pivotally connected to the corresponding stretcher 14. As shown in FIG. 2, each torsion spring 18 has one end fixed to one of the ribs 13 and the opposite end fixed to the corresponding stretcher 14.

Referring back to FIG. 1, when it is desired to close the umbrella structure, the runner 12 is slid downward from an upper position on the shaft 10. The runner 12 will drive each stretcher 14 and rib 13 to close the canopy 15 until the runner 12 is engaged with and fixed in position by the protruding catch 16. During the process, each torsion spring 18 is compressed by one of the ribs 13 and the corresponding stretcher 14 and stores energy therein.

To open the umbrella structure, the protruding catch 16 is pressed, and the runner 12 is slid upward at the same time. As a result, each torsion spring 18 releases the energy stored therein and generates an elastic restoring force that drives one of the ribs 13 to open the canopy 15, making it possible to open the umbrella structure with less effort than conventionally required.

Figure 3:
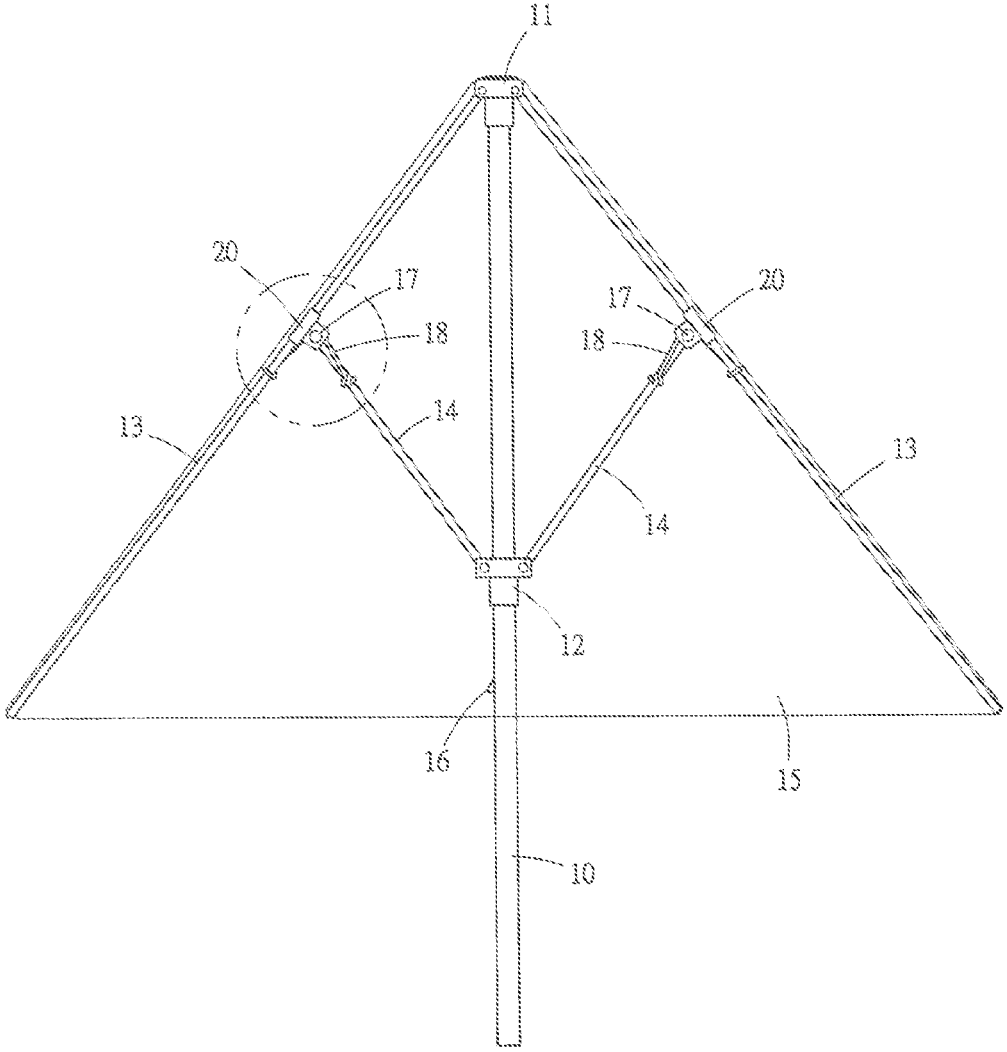
FIG. 3 is a schematic drawing of the improved umbrella structure in the second embodiment of the present invention.

FIG. 3 schematically shows the second embodiment of the structure of the present invention.

Figure 4:
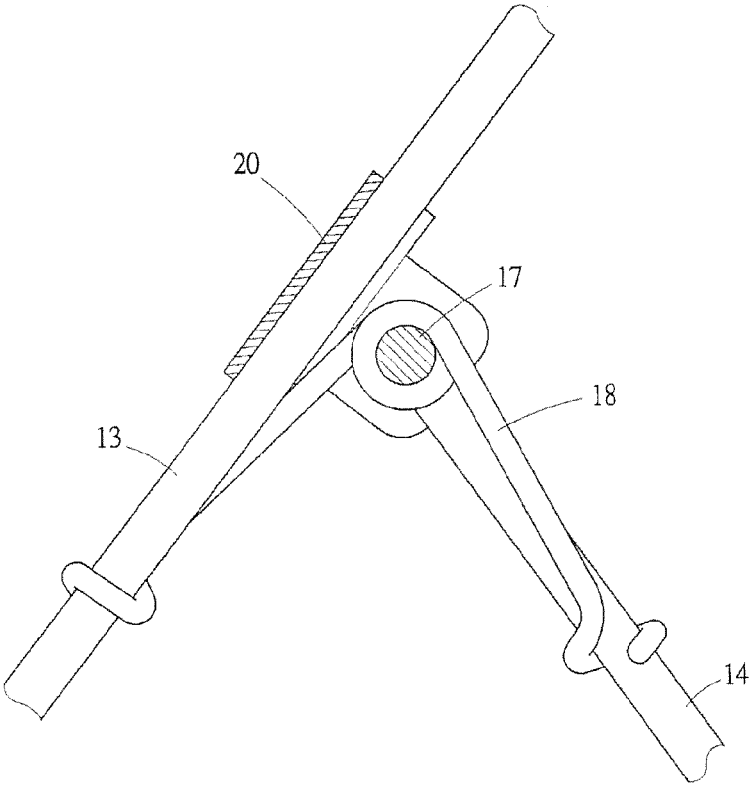
FIG. 4 is an enlarged view of the portion where one of the ribs and the corresponding stretcher in FIG. 3 are pivotally connected.

FIG. 4 is an enlarged view of the portion where one of the ribs 13 and the corresponding stretcher 14 in FIG. 3 are pivotally connected.

The improved umbrella structure in the second embodiment in FIG. 3 is similar to the first embodiment in FIG. 1 in including the shaft 10, the top notch 11, the runner 12, the plural ribs 13, the plural stretchers 14, the canopy 15, and the plural torsion springs 18.

The second embodiment in FIG. 3 is different from the first embodiment in that each rib 13 is provided with a joiner 20 for connecting with the corresponding stretcher 14, and that each pivot pin 17 pivotally connects one of the joiners 20 and the corresponding stretcher 14. The torsion springs 18 are still mounted around the pivot pins 17 respectively, as shown in FIG. 4.

When it is desired to open the umbrella structure, the protruding catch 16 is pressed, and the runner 12 is simultaneously slid upward. Consequently, each torsion spring 18 releases the energy stored therein, and the elastic restoring force of each torsion spring 18 drives one of the ribs 13 to open the canopy 15, allowing the umbrella structure to be opened with more ease and less effort than its prior art counterparts.

The advantages of the present invention are obvious, including a lower overall weight and a potential decrease in production costs as compared with the conventional umbrellas. These advantages are attributable to the following. First, the torsion springs 18 are small and lightweight. Second, each torsion spring 18 is mounted where one of the ribs 13 is pivotally connected to the corresponding stretcher 14, so the shaft 10 does not require complicated internal parts.

The structure of the present invention is simple and can be used not only in compact umbrellas to provide an effort-saving opening function, but also in large beach umbrellas and garden umbrellas, where the torsion springs are equally capable of helping the ribs open the canopy, thereby facilitating the opening process.

The embodiments illustrated in FIG. 1 and FIG. 3 are provided only to demonstrate the practicability of the present invention and are not intended to restrict the scope of the present invention. All umbrella structures having a pivot pin between each rib and the corresponding stretcher can benefit from the design of the present invention and be opened with less effort than conventionally required.

What is claimed is:

1. An umbrella structure, comprising:

a shaft provided with an elastic protruding catch;

a top notch fixed at a top end of the shaft;

a runner mounted around and slidable up and down along the shaft, the runner being engageable with the protruding catch so as to be fixed in position on the shaft;

a plurality of ribs, each said rib having an upper end pivotally connected to the top notch;

a plurality of stretchers, each said stretcher having an upper end pivotally connected to an intermediate portion of a said rib by a pivot pin, each said stretcher having a lower end pivotally connected to the runner;

a canopy covering and connected to each said rib; and a plurality of torsion springs, each said torsion spring being mounted around a said pivot pin, by which a said rib is pivotally connected to a corresponding one of the stretchers, each said torsion spring having an end fixed to a said rib and an opposite end fixed to the corresponding one of the stretchers;

wherein in order to close the umbrella structure, the runner is slid downward from an upper position on the shaft such that not only does the runner drive each said stretcher and each said rib to close the canopy until the runner is engaged with and fixed in position by the protruding catch, but also each said torsion spring is compressed by a said rib and the corresponding one of the stretchers and stores energy therein; and in order to open the umbrella structure, the protruding catch is pressed, and the runner is simultaneously slid upward such that each said torsion spring releases the energy stored therein and generates an elastic restoring force driving a said rib to open the canopy.

2. The umbrella structure of claim 1, wherein each said rib is provided with a joiner for connecting with the corresponding one of the stretchers, and each said torsion spring is mounted around a said pivot pin, by which a said joiner is pivotally connected to the corresponding one of the stretchers.

* * * * *